United States Patent [19]

Nicholson et al.

[11] Patent Number: 4,873,130

[45] Date of Patent: Oct. 10, 1989

[54] COATING PROCESS FOR THE PREPARATION OF COHERENT PROTECTIVE LAYER

[75] Inventors: John W. Nicholson, Hampton; Alan D. Wilson, Liphook, both of England

[73] Assignee: National Research Development Corporation, England

[21] Appl. No.: 235,389

[22] Filed: Aug. 22, 1988

Related U.S. Application Data

[63] Continuation of Ser. No. 846,904, Apr. 1, 1986, abandoned.

[30] Foreign Application Priority Data

Apr. 1, 1985 [GB] United Kingdom ..... 8508461

[51] Int. Cl.[4] ..... B27N 5/02; B05D 3/02

[52] U.S. Cl. ..... 428/35.8; 427/388.2; 427/388.4

[58] Field of Search ..... 428/35, 36; 427/388.1, 427/388.2, 388.4

[56] References Cited

U.S. PATENT DOCUMENTS

| | | | |
|---|---|---|---|
| 3,836,494 | 9/1974 | Hekal et al. | 427/388.2 X |
| 3,908,049 | 9/1975 | Fitko | 427/386 |
| 3,968,311 | 7/1976 | Hekal et al. | 427/236 X |
| 4,065,590 | 12/1977 | Selensky | 427/388.2 X |
| 4,165,242 | 8/1979 | Kelly et al. | 427/409 X |
| 4,169,088 | 9/1979 | Hansen | 427/385.5 X |
| 4,199,622 | 4/1980 | Kokumai et al. | 427/239 |
| 4,238,535 | 12/1980 | Talsma et al. | 427/409 X |
| 4,358,508 | 11/1982 | Tanaka et al. | 427/409 X |
| 4,421,569 | 12/1983 | Dichter et al. | 427/388.2 X |
| 4,520,043 | 5/1985 | Davidian | 427/388.2 X |
| 4,536,420 | 8/1985 | Rickert, Jr. | 427/388.2 X |
| 4,594,112 | 6/1986 | Suzuki et al. | 427/388.2 X |

FOREIGN PATENT DOCUMENTS

| | | |
|---|---|---|
| 104316 | 4/1984 | European Pat. Off. . |
| 2023759 | 5/1970 | France . |
| 2341630 | 7/1977 | France . |
| 431604 | 4/1974 | Japan . |
| 741654 | 12/1955 | United Kingdom . |
| 1011981 | 12/1965 | United Kingdom . |
| 1034268 | 6/1966 | United Kingdom . |
| 1123285 | 8/1968 | United Kingdom . |
| 1126045 | 9/1968 | United Kingdom . |
| 1127232 | 9/1968 | United Kingdom . |
| 1183945 | 3/1970 | United Kingdom . |
| 1291019 | 9/1972 | United Kingdom . |
| 1371083 | 10/1974 | United Kingdom . |
| 1475336 | 6/1977 | United Kingdom . |
| 1486610 | 9/1977 | United Kingdom . |
| 1504845 | 3/1978 | United Kingdom . |
| 1502044 | 6/1978 | United Kingdom . |
| 1513867 | 6/1978 | United Kingdom . |
| 5649 | 11/1979 | United Kingdom . |
| 1559048 | 1/1980 | United Kingdom . |
| 1566942 | 5/1980 | United Kingdom . |
| 2052546 | 1/1981 | United Kingdom . |
| 2059968 | 4/1981 | United Kingdom . |
| 2152065 | 7/1985 | United Kingdom . |

OTHER PUBLICATIONS

W. H. Perkin et al., J. Chem. Soc., vol. 85, Transactions 1904, pp. 120–140.

*Primary Examiner*—Thurman K. Page
*Attorney, Agent, or Firm*—Jacobs & Jacobs

[57] ABSTRACT

A process for the preparation of a coherent protective layer on a substrate surface of a body, the substrate surface comprising elemental metal or an alloy thereof, which process comprises applying to the substrate surface an aqueous solution of a partially neutralised homo- or copolymer of a mono- or polybasic ethylenically unsaturated acid; and heat-curing the layer so formed at a temperature above 180° C.

14 Claims, No Drawings

COATING PROCESS FOR THE PREPARATION OF COHERENT PROTECTIVE LAYER

This is a continuation of Ser. No. 846,904 filed Apr. 1, 1986, now abandoned.

This invention relates to coating processes; more particularly, this invention relates to processes for coating substrates, particularly substrates comprising elemental metal or an alloy thereof, to prevent their interaction with fluid media, especially aqueous fluid media, into contact with which they might otherwise come; and to substrates so coated.

It is known from Japanese Patent Publication No. 74 31604 that tinned steel sheet may be provided with scratch-resistant coatings which have good adhesion to paint by dipping the sheet into a solution containing poly(acrylic acid) and/or an acrylic acid-vinyl alcohol copolymer and then heating to a temperature below the melting point of tin.

However, such coatings are found not to be acid resistant. This invention seeks to provide coatings which are improved in at least this respect.

According, therefore, to one aspect of this invention there is provided a process for the preparation of a coherent protective layer on a substrate surface of a body, the substrate surface comprising elemental metal or an alloy thereof, which process comprises applying to the substrate surface an aqueous solution of a partially neutralised homo- or copolymer of a mono- or polybasic ethylenically unsaturated acid; and heat-curing the layer so formed at a temperature above 180° C.

While the body having the substrate surface may have small dimensions, the present invention is of particular advantage in its application to bodies of large dimension, including structural bodies. The term "body" as used herein may include bars, strips, sheets, rods, tubes and other cross-sections of solid or hollow stock as well as structures fabricated therefrom. The term "tube" as used herein may include any closed or open-ended elongate hollow stock of substantially constant cross-section, desirably with an axis of symmetry; for example elongate hollow stock of substantially constant circular, elliptical, square, rectangular or triangular cross-section.

The body may have one or more substrate surfaces, which may be internally located substrate surfaces, which comprise elemental metal or an alloy thereof. The or each such surface should have a coherent protective layer in accordance with the invention at least in the or each region which would otherwise be in, or may come into, contact with fluid media; for example, aqueous beverages or sea water. Desirably, all such surfaces should have a coherent protective layer as aforesaid over substantially their entire extent.

The elemental metal alloy thereof is usually electropositve metal and generally comprises substantially the entire substrate surface. The invention is of particular, but not exclusive, relevance to a ferrous metal substrate surface; for example, a steel such as a structural steel. In accordance, however, with a preferred embodiment of this invention the body is a canister or other item of holloware and the or each surface of which would otherwise be in contact with fluid media, for example aqueous beverages of other comestibles, comprises aluminum, mild steel, electro-coated chromium steel or tin plate.

The aqueous solution of the partially neutralised homo-or copolymer may be prepared by reacting, in the presence of water (i) a compound effective in aqueous media to convert a free carboxyclic acid group to a carboxylate group with (ii) a homo- or copolymer of a mono- or polybasic ethylenically unsaturated acid. Preferably compound 1 comprises a metal in a positive oxidation state or a substituted or unsubstituted ammonium compound or corresponding free base, especially a monovalent metal.

The compound (i) may suitably comprise a substituted or unsubstituted ammonium compound; preferably it comprises a basic or amphoteric oxide or hydroxide, or a salt of weak or volatile acid. There are many basic or amphoteric oxides or hydroxides which can be utilised in accordance with this invention: examples include Group 1A oxides or hydroxides such as LiOH, NaOH and KOH; Group IIA oxides or hydroxides such as MgO, $Mg(OH)_2$ and $Ca(OH)_2$; "$Ti(OH)_4$"; "$Zr(OH)_4$"; $V_2O_5$; $Cu_2O$; CuO; ZnO; $Al_2O_3 \times H_2O$ and $SnO_2$. Salts of weak or volatile acids include carbonates, monocarboxylates, such as formates, acetates and halides, such as the chlorides of Al, Ba, Ca, Co, Cu, Mg, Sn, Th, Ti, Zn and Zr. The compound (i) may comprise the same, or one of the same, metals as that comprising the substrate surface. Such a compound (i) may be formed in situ, for example by oxidation, such as is disclosed in UK 1483362.

Examples of homo- or copolymers (ii) include those of an unsaturated carboxylic acid; for example, those prepared by the homopolymerisation or copolymerisation of aconitic acid, acrylic acid, citraconic acid, fumaric acid, glutaconic acid, itaconic acid, maleic acid, mesaconic acid, methacrylic acid, muconic acid and tiglic acid, and the copolymerisation of these acids with other unsaturated aliphatic monomers for example vinyl monomers, such as vinyl hydrocarbon monomers, vinyl ethers, acrylamide or acrylonitrile. Particularly noteworthy are the homopolymers of acrylic acid and its copolymers, particularly copolymers of acrylic acid and itaconic acid, especially those described and claimed in UK No. 1484454. Good results have also been obtained using a copolymer of vinyl methyl ether and maleic acid. Examples of homo-or coplymers of an unsaturated sulphonic acid include those prepared by the homo-polymerisation or copolymerisation of ethylene sulphonic acid; for example, a copolymer of the methyl ester of acrylic acid and vinyl sulphonic acid.

It is also possible to use a hydrolysable precursor of such polymers for example a poly(carboxylic acid anhydride); furthermore, polyacrylic acids may be prepared by hydrolysis of corresponding polyacrylonitrile or anhydride. The hydrolysable precursor of a poly(carboxylic acid) may be a homopolymer of an unsaturated carboxylic acid or a copolymer with an above-mentioned other carboxylic acid or anhydride thereof, or a copolymer of an unsaturated carboxylic acid anhydride with an unsaturated aliphatic monomer, for example vinyl monomers, such as vinyl hydrocarbon monomers, linear or cyclic vinyl ethers, acrylamide or acrylonitrile, for example pyran copolymer. Good results may be obtained by using homopolymers of maleic anhydride or vinyl orthophthalic anhydride, or copolymers thereof, especially, block copolymers thereof, with ethylene, propylene, butenes, styrene and vinyl methyl ether. Mixtures of such homo- or copolymers (ii) may be used. Preferably, the homo- or copolymer (ii) is in aqueous solution.

Copolymer (ii) desirably comprises at least 40 mol % preferably at least 60 mol %, especially at least 75 mol %, of polymerised unsaturated carboxylic acid residues.

It is to be understood, however, that both from the standpoints of availability and of good results, polyacrylic acid is the preferred homo- or copolymer (ii) used in the process of this invention.

It is found that, in accordance with a preferred feature of this invention, care must be paid in relation to the ratio of compound (i) to homo- or copolymer (ii). In general, the amount of (i) applied to the substrate surface should be sufficient to neutralise at least 5% of the acid groups of homo- or copolymer (ii). The amount (i) should not, however, be sufficiently high to render to the protective layer swellable in aqueous media; and this amount varies with the nature of (i). Thus, in the case of Na and K, the amount of (i) applied to the substrate surface should be sufficient to neutralise no more than 20%, preferably no more than 15% of the acid groups of homo-or copolymer (ii). In the case of ammonia, substituted amines, and their corresponding sodium salts the amount may be higher; for example, sufficient to neutralise no more than 80%, preferably no more than 50%, of the acid groups of homo- or copolymer (ii).

Compound (i) and homo- or copolymer (ii) may be mixed before application; for example, commercially available partially neutralised homo- or copolymers or mono- or polybasic ethylenically unsaturated acids may be used. At least one of (i) or (ii) may be brush coated onto the substrate surface: at least one of (i) or (ii) may be spray coated onto the substrate surface.

In accordance with a further feature of this invention the layer so formed is cured by heating to a temperature above 180° C., preferably from 200° C., to 300° C., preferably to 250° C., or below the substrate melting point, if this is lower (as in the case with tin-plate). Heating is effected for a short period of time as is possible: typically from 5 to 30, preferably from 10 to 20, minutes.

This invention also provides a body, especially a canister, which has, on at least one substrate surface thereof, a coherent protective layer prepared by a process of any preceding claim.

This invention further provides an ionomeric composition which is the product of mixing components (i) and (ii) as herein defined; and curing the mixture so formed by heating above ambient temperature.

The following Examples illustrate the invention.

EXAMPLE 1

An aqueous coating formulation was prepared by adding sufficient sodium hydroxide pellets to a 10% by weight aqueous solution of poly(acrylic acid) (E7, average molecular weight 30,000 ex Allied Colloids Ltd) to neutralise 10% of the available carboxylic acid groups; a few drops of a non-ionic surfactant, added to improve the wetting of the substrate by the formulation, (Lisapol NX comprising ethoxylated nonyl phenol ex ICI Ltd.) were added to complete the formulation. The formulation was then coated, by brushing, onto an aluminum substrate; dried; and cured by heating in air for 10 minutes at 235° C.

The resulting coating was glossy and pale brown in appearance; it showed excellent adhesion to the aluminum substrate: thus, it could be plastically deformed by subjecting the coated substrate to flexure through 180° about a 6 mm mandrel (BS 3900 (part E1)) without exhibiting any sign of damage. It was also unaffected by soaking the coated substrate in distilled water for 30 minutes at ambient temperature, and showed but very slight loss of gloss on exposure either for 3 hours to a boiling 5% by weight aqueous acetic acid solution or for 24 hours to a 3% by weight aqueous sodium chloride solution at ambient temperature.

EXAMPLE 2

Example 1 was repeated except that lithium hydroxide was used in the neutralisation. The resulting coating showed improved resistance on exposure to boiling tap water for 1 hour when compared with that of Example 1 but had slightly inferior resistance on exposure to a boiling 5% by weight aqueous acetic acid solution.

EXAMPLE 3

Example 1 was repeated except that potassium hydroxide was used in the neutralisation. The resulting coating showed superior resistance on exposure to both boiling tap water and a boiling 5% by weight aqueous acetic acid solution when compared with that of Example 1.

A comparative experiment was effected in which the potassium hydroxide was omitted. On treatment with boiling 5% by weight aqueous acetic acid the coating completely dissolved.

EXAMPLE 4

Examples 1 to 3 were repeated except that tin-plate was used as substrate. In each case, the resulting coating had comparable properties.

EXAMPLE 5

Example 3 was repeated except that a 25% by weight aqueous solution of the poly(acrylic acid) was used; the coating was effected by drawing down with a wire-wound coating bar; and that the curing was effected by heating for 10 minutes at 225° C. The resulting coating was very similar to that obtained in Example 3.

EXAMPLE 6

Example 5 was repeated except that tin-plate was used as substrate. The resulting coating was very similar to that obtained in Example 3.

EXAMPLE 7

Example 5 was repeated except that mild steel was used as substrate. The resulting coating was very similar to that obtained in Example 3.

EXAMPLE 8

Example 5 was repeated except that electro-coated chromium steel ("tin-free steel") was used as substrate. The resulting coating was very similar to that obtained in Example 3.

EXAMPLE 9

Example 1 was repeated except that calcium hydroxide was used in the neutralisation; and that the curing was effected by heating for 30 minutes at 235° C. The resulting coating has properties which were very similar to those obtained in Example 1.

EXAMPLE 10

Example 1 was repeated except that sufficient sodium hydroxide was added to neutralise 5% of the available carboxylic acid groups. The resulting coating has properties which were very similar to those obtained in Example 1.

EXAMPLE 11

Example 2 was repeated except that sufficient lithium hydroxide was added to neutralise 15% of the available carboxylic acid groups. The resulting coating has properties which were very similar to those obtained in Example 2.

EXAMPLE 12

Example 1 was repeated except that cobalt (II) acetate was used in the neutralisation; and that a 5% by weight aqueous solution of the poly(acrylic acid) was utilised. The resulting coating has properties which were very similar to those obtained in Example 1.

EXAMPLE 13

Example 12 was repeated except that aluminum chloride was used in the neutralisation. The resulting coating has properties which were very familiar to those obtained in Example 1.

EXAMPLE 14

Example 12 was repeated except that zinc acetate was used in the neutralisation. The resulting coating has properties which were very similar to those obtained in Example 1.

EXAMPLE 15

Example 12 was repeated except that copper (II) formate was used in the neutralisation. The resulting coating has properties which were very similar to those obtained in Example 1.

EXAMPLE 16

Example 9 was repeated except that a 10% by weight aqueous solution of vinymethylether-maleic acid copolymer (Gantrex S95 ex GAF (Great Britain) Ltd) was used; and that curing was effected by heating for 10 minutes at 235° C. The resulting coating had excellent chemical resistance, adhesion and flexibility. In particular, it showed only a very slight loss in gloss on exposure for 1 hour to a boiling 5% by weight aqueous nitric acid solution.

EXAMPLE 17

Example 1 was repeated except that sufficient 35% by weight aqueous ammonia ("0.88" ammonia) was used to neutralise 50% of the available carboxylic acid groups. The resulting coating has properties which were very similar to those obtained in Example 1.

EXAMPLE 18

Example 1 was repeated except that 21.5% by weight of ethylene glycol (which acts as a cross-linking agent by esterifying free carboxylic acid groups), based on the weight of the poly(acrylic acid), was also added to give a carboxylic acid:hydroxyl group ratio of 2:1; and that curing was effected by heating for 10 minutes at 200° C. The resulting coating has properties which were very similar to those obtained in Example 1.

EXAMPLE 19

Example 1 was repeated except that sufficient poly(vinyl alchohol) was added to esterify 75% of the free carboxyclic acid groups. The solution was applied by aerosol spray to an aluminum substrate and cured by heating for 10 minutes at 250° C. The coating had excellent resistance to 3% by weight aqueous sodium chloride solution (24 hours) and to citrate buffer (pH 25.5 at 37° C.) (14 days).

EXAMPLE 20

Example 19 was repeated except that the poly(vinyl alcohol) was replaced by poly(ethylene glycol) (equivalent weight 200). The coating had excellent resistance to 3% by weight aqueous sodium chloride solution; to citrate buffer, and to boiling acetic acid.

All of the exemplified coatings had complete adhesion when tested under BS 3900, Part E2.

We claim:

1. A process for the preparation of a coherent protective layer on a substrate surface of a body, the substrate surface comprising elemental metal or an alloy thereof, which process comprises reacting (i) a compound of a group IA metal, effective in aqueous media to convert a free carboxylic acid group to a carboxylate group with (ii) an aqueous solution consisting of water and a homopolymer of a mono- or polybasic ethylenically unsaturated acid or a copolymer of a mono- or polybasic ethylenically unsaturated acid comprising at least 40 mol % of polymerized unsaturated carboxylic acid residues, the amount of (i) being sufficient to neutralize from 5 to 20% of the acid groups of said homo-or copolymer (ii); applying to the substrate surface the aqueous solution consisting of water and partially neutralized homo- or copolymer of a mono- or polybasic ethylenically unsaturated acid resulting from said reaction; and heat-curing the layer so formed at a temperature above 180° C.

2. A process according to claim 1, wherein the body is an item of holloware.

3. A process according to claim 1, wherein the substrate surface comprises aluminum, mild steel, electrocoated chromium steel or tin-plate.

4. A process according to claim 1, wherein compound (i) comprises a basic oxide of hydroxide, or a salt of a weak or volatile acid.

5. A process according to claim 1, wherein homo- or copolymer (ii) comprises a homo- or copolymer of an unsaturated carboxylic carboxylic acid or a hydrolyzable precursor thereof.

6. A process according to claim 1, wherein copolymer (ii) comprises a least 40 mol % of polymerized unsaturated carboxylic acid residues.

7. A process according to claim 1 wherein (i) and (ii) are mixed before application.

8. A process according to claim 1, wherein at least one of (i) and (ii) is brush coated onto the substrate surface.

9. A process according to claim 1, wherein at least one of (i) and (ii) is spray coated onto the substrate surface.

10. A process according to claim 1, wherein the layer so formed is cured by heating to a temperature from 200° C. to 300°, or to below the substrate melting point if this is lower than 300° C.

11. A body, which has, on at least one substrate surface thereof, a coherent protective layer prepared by a process of claim 1.

12. A process according to claim 1, wherein compound (i) is a compound of lithium, sodium or potassium.

13. A process according to claim 4, wherein compound (i) is a compound of lithium, sodium or potassium.

14. A process according to claim 1, wherein compound (i) is LiOH, NaOH or KOH.

* * * * *